United States Patent [19]

Hennequin

[11] 4,200,135

[45] Apr. 29, 1980

[54] VENETIAN BLIND TILTING AND LIFTING UNIT

[75] Inventor: Petrus J. Hennequin, Rotterdam, Netherlands

[73] Assignee: Hunter Douglas International N.V., Netherlands Antilles

[21] Appl. No.: 911,822

[22] Filed: Jun. 2, 1978

[30] Foreign Application Priority Data

Jun. 11, 1977 [DE] Fed. Rep. of Germany ..... 2726452

[51] Int. Cl.[2] ..... E06B 9/30

[52] U.S. Cl. ..... 160/168 A; 160/176 R; 160/178 R

[58] Field of Search ..... 160/166–178

[56] References Cited

U.S. PATENT DOCUMENTS

| | | | |
|---|---|---|---|
| 2,737,235 | 3/1956 | Hediger | 160/170 |
| 2,758,644 | 8/1956 | Virlouvet | 160/170 |
| 3,181,595 | 5/1965 | Pender | 160/171 |
| 3,310,099 | 3/1967 | Hunter et al. | 160/171 |
| 3,918,513 | 11/1975 | Englund et al. | 160/176 R |

*Primary Examiner*—Peter M. Caun

*Attorney, Agent, or Firm*—Pennie & Edmonds

[57] ABSTRACT

The invention relates to a drive for a venetian blind, the slats of which can be raised or lowered by a lift tape and tilted by a tilting member, having a lift tape drum drivable through a drive shaft, a tilting drum serving to actuate the tilting member, a slip clutch in the path of force between the tilting drum and the drive shaft, and a bearing block which comprises two parallel bearing plates traversed by the drive shaft and between which the lift tape drum, the tilting drum and the slip clutch are axially arranged.

12 Claims, 7 Drawing Figures

VENETIAN BLIND TILTING AND LIFTING UNIT

BACKGROUND

In known forms of such drives, the structural means required for the arrangement and suspension of the lift tape drum, tilting drum and slip clutch are very expensive. The same is true of the mounting. Another disadvantage is the relatively great space requirements of these prior devices.

It is further disadvantageous that the lift tape drum, the tilting drum and the slip clutch can be arranged inside the bearing block only in a certain predetermined mounting position, with the result that each bearing block and especially the drive mechanism must be so mounted that it is usable only in a very specific operating position, and that for other operating positions within a head rail the bearing block must have a separate and different design. As a result inventories must be maintained of more parts.

BRIEF DESCRIPTION OF THE INVENTION

It is one object of the present invention to design a drive of the above mentioned kind so that it can be manufactured and mounted in a particularly simple manner. Also the present drive is such that it can be used in different installed positions as needed thus reducing inventory.

To these ends, the present invention provides a pair of spaced bearing plates between which there extends a rotatably mounted continuous hub supported by said plates. The slip clutch, the tilting drum and the lift tape drum are designed to be fitted on different spaced axial zones of this hub. As a result, the structure required for the support of the lift tape drum, tilting drum and slip clutch is greatly simplified, and a considerable simplification of the mounting system is also achieved. Further, the drive is particularly compact and requires little space. As will be explained below, it is possible also to use the drive in different mounting and operating positions without the need for additional parts. Reducing the required structure results in a considerable reduction of manufacturing costs.

In accordance with the invention, a bearing block is provided comprising two substantially parallel spaced bearing plates. The hub is insertable endwise from outside of the bearing block and extends between said bearing plates and is supported by said plates. Adjacent one end the hub is supported in a bearing ring which is a part of one of said bearing plates and adjacent the other end the hub passes through the lift tape drum which has an outwardly extending bearing ring which receives said end of the hub and is itself journalled in a bearing ring opening in the other bearing plate.

In addition to the lift tape drum, the hub also receives on axially spaced positions along its length a slip clutch and the tilting drum.

This arrangement provides for very ready and quick assembly since the lift tape drum, tilting drum, and slip clutch may be positioned between the spaced bearing plates and the hub inserted through the first bearing plate, the slip clutch, the tilting drum, and the lift tape drum. The hub is held against further axial movement inwardly toward and through the second bearing plate by means of a shoulder thereon which bears against a face of the lift tape drum. The hub is held against removal in the opposite direction by means of a retaining cap secured to the adjacent bearing plate.

Still another feature of the invention is the provision of a series of holes in the first bearing plate arranged in a circle about the bearing ring therein which holes are adapted to receive stop pins. The stop pins cooperate with a catch ring to control the response of the slip clutch and the stop pins may be adjusted by removal and insertion in any selected holes in the bearing plate in order to suitably adjust the response range of the slip clutch.

BRIEF DESCRIPTION OF THE DRAWINGS

The above mentioned features of the invention, together with others as well as the manner of making and using the same will be apparent to those skilled in the art from the following description and drawings in which.

DETAILED DESCRIPTION OF THE INVENTION

Figure 1:
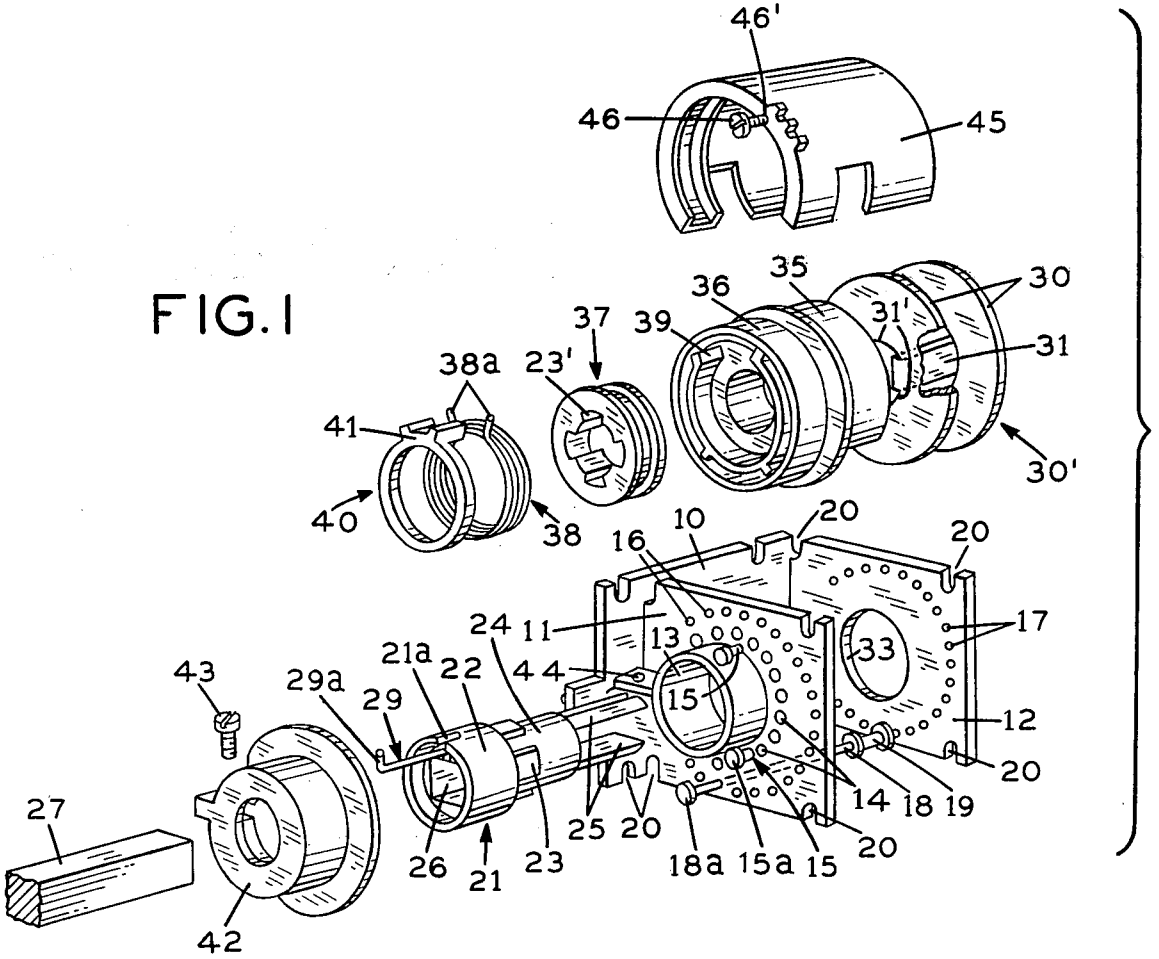
FIG. 1 is an exploded perspective view showing the individual parts of the drive of this invention.

As shown in FIG. 1, the drive of this invention includes a bearing block comprising a base plate 10 and two parallel spaced bearing plates 11 and 12 secured thereto by any suitable conventional means (not shown) or formed integrally therewith. The first bearing plate 11 incorporates a bearing ring 13 which may be separately formed and secured in a suitable opening in bearing plate 11 or which may be formed integrally with bearing plate 11. First bearing plate 11 also includes a series of bores 14 therethrough arranged in a circle about the bearing ring 13 as shown. Two stop pins 15 each having an enlarged head portion **15*a* are provided for insertion in selected bores 14** for reasons hereinafter further explained.

First bearing plate 11 also includes a plurality of bores 16 therethrough arranged in a circle of a radius greater than the radius of the circle in which the bores 14 are arranged. Second bearing plate 12 has a plurality of bores 17 extending therethrough and arranged in a circle of a radius which is the same as the radius of the circle in which the bores 16 are arranged. Further, the bores 17 are in alignment with the bores 16 in first bearing plate 11. As shown, the bores 16 and 17 do not extend in a complete circle, but, rather, they subscribe approximately three-fourths of a circle. In the area of the circle adjacent the base plate 10, the bores 16 and 17 are absent. The reasons for this will be presently apparent.

Axle 18 extends between two of the aligned bores 16 and 17 and has rotatably mounted thereon a lift tape guide roller 19. The guide roller 19 guides the lifting tape as it is wound about or unwound from the lift tape drum generally indicated at 30'. Depending upon the position of the bearing block with respect to the head rail and the slats of a venetian blind the axle 18 with its roller 19 may be positioned in any one of the pairs of aligned bores 16 and 17.

Figure 3:
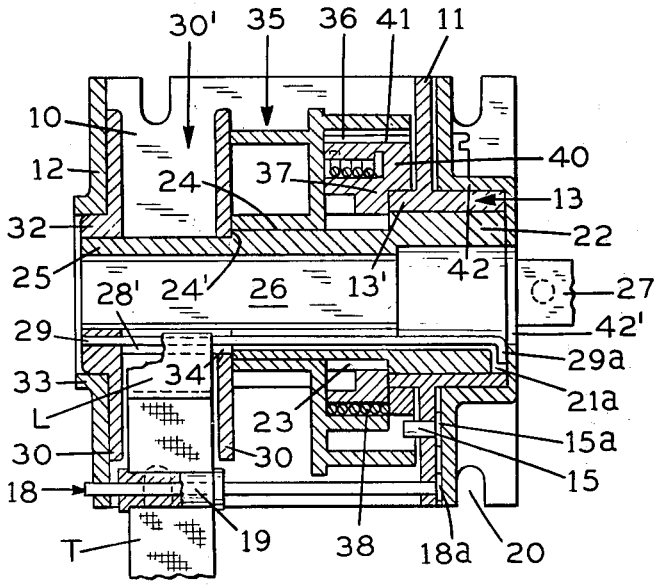
FIG. 3 is a longitudinal cross section through the assembled drive.
Figure 4:
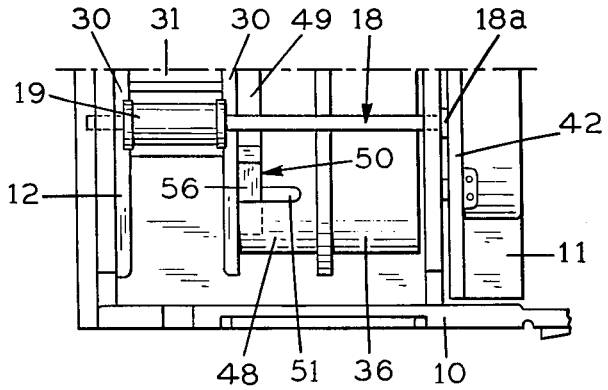
FIG. 4 is a portion of a bottom plan view of the drive viewed from below in FIG. 3.

Base plate 10 and bearing plates 11 and 12 are provided at various points along their edges with cutouts or notches 20 arranged in a suitable pattern to provide means for mounting the bearing block in different operative positions in a head rail (not shown). It will be understood by those skilled in the art that two drive mechanisms are required for each venetian blind with one mounted adjacent to each end of the head rail and within the head rail. As shown in FIG. 3, the drive mechanism is oriented to be mounted within the right hand end of a head rail. For the left hand end of the head rail and the blind, the drive mechanism of FIG. 3 will be reversed from left to right with respect to the position shown in FIG. 3. That is to say that for the left hand end of the head rail, the right hand (or outer end) of the drive as shown in FIG. 3 will be on the left and left hand end (or inner end) of the drive mechanism as shown in FIG. 3 will be toward the right. As will be apparent, when the drive mechanism is mounted on the left hand side it may be necessary to relocate the axle 18 and the guide roller 19 so that the same are positioned in alignment with and below the lift tape drum 30'. Similarly, relocation of the stop pins 15, as further described hereinafter, may also be required. In no useful position of the drive, however, will it be necessary to position the roller 19 adjacent the base plate 10. As such no holes 16 or 17 are provided in the area adjacent thereto.

An elongated hub 21 is provided to extend between the first and second bearing plates 11 and 12. A cylindrical portion 22 of the hub 21 fits rotatably within the bearing ring 13. In axial alignment along the hub 21 with the cylindrical portion 22 is the spline portion 23 of a spline and groove connection 23,23'. Axially beyond the splines 23 is a cylindrical bearing face 24 beyond which, in turn, extend four fingers 25. These fingers 25 are adapted to fit within the lift tape drum 30'. The lift tape drum 30' includes two side flanges 30 having openings 31' therethrough at their center. Connecting the two side flanges 30 at the openings 31' are a plurality of bridging elements 31 which are of a dimension to fit between adjacent fingers 25 of the hub 21. Such size being measured circumferentially of the opening 31'. Since there is a bridging element 31 for each space (four) between adjacent fingers 25 and since the bridging elements are of substantially the same thickness measured in the radial direction as the fingers 25 there is provided a substantially continuous hub between the flanges 30 to receive the lift tape to be wound thereabout. This hub, however, is not completely continuous for the same is designed to receive a locking pin 29 (see FIG. 3). As shown in FIG. 3, lifting tape "T" has a portion at the end thereof folded over and suitably secured by stitching, adhesive or the like to provide a loop "L". The end of loop "L" may be inserted into an opening or groove 28' in the circumference of the hub (made up of bridging elements 31 and fingers 25) of lifting drum 30'. This groove 28' may comprise a groove in one of the fingers 25 or in one of the bridging elements 31, or, preferably, the same may be provided by so dimensioning one of the fingers 25 and one of its adjacent bridging elements 31 as to provide a space therebetween for receipt of the loop "L" between the side flanges 30. This groove 28' is aligned with a suitable bore in the left hand flange 30 as viewed in FIG. 3 for receipt of the end of the retaining pin 29. The right hand flange 30 as viewed in FIG. 3 has a bore 34 also in alignment with the groove 28' and the bore in the left hand flange 30. This bore 34 also receives the retaining pin 29.

The hub 21 has a square opening 26 therethrough for receipt of a square drive shaft 27. In one of the walls of opening 26 there is a longitudinal groove 28. Groove 28 is in alignment with bore 34, groove 28' and the bore in the left hand (as viewed in FIG. 3) flange 30 all of which receive the retaining pin 29. By inserting the end of the loop "L" into the groove 28' and then passing the retaining pin 29 through the loop "L" the tape "T" is secured to the lifting drum 30' and upon rotation of the drum 30' the tape "T" will be wound upon or unwound from the drum 30'.

The left hand flange 30 as viewed in FIG. 3 has an outwardly extending bearing ring 32 rotatably mounted in a cooperating bearing ring boss 33 formed in the bearing plate 12. The fingers 25 of the hub 21 fit within the bearing ring 32 and rotate therewith by virtue of their fitting between the bridging elements 31. The portion 24 of hub 20 is of greater diameter than the diameter of the outer surface of fingers 25 thus providing a shoulder 24' which bears against the outer (right hand as viewed in FIG. 3) surface of the right hand (as viewed in FIG. 3) flange 30. This engagement between the shoulder 24' and the face of the right hand flange 30 limits the insertion of the hub 21 into the drive mechanism from right to left as viewed in FIG. 3. On its outer end, the hub 21 is retained in position by a retaining cap 42 secured to the bearing plate 11 by a screw 43 screwed into a tapped hole 44 on an outwardly extending portion of the bearing plate 11 (see FIG. 1). Accordingly, the hub 21 is secured against movement in the left or right direction as viewed in FIG. 3. It will be seen, therefore, that the hub 21 is mounted at one end by means of the cylindrical bearing portion 22 in the bearing ring 13 on the bearing plate 11. At its other end, the hub 21 is supported for rotation in the bearing ring 33 of the bearing plate 12 by virtue of its engagement within the bearing ring 32 of the lifting drum 30'.

On the enlarged area of the hub 24 which serves as a bearing face, there is mounted a tilting drum 35 which is free to rotate with respect to the bearing face 24 of the hub 21. The tilting drum 35 includes a clutch housing 36 formed integrally therewith. Clutch housing 36 surrounds a clutch ring 37 which is non-rotationally mounted to the hub 21 by virtue of the grooves 23' therein which engage the splines 23 on hub 21. A spiral spring 38 surrounds the outer circumference of clutch ring 37 and has each of its ends 38*a* bent to extend radially outward of the axis of the hub 21. These ends 38*a* cooperate with stops 39 formed inside and integral with the clutch housing 36. The stops 39 are spaced apart circumferentially at a somewhat greater distance from each other than the distance between the ends 38*a* of the spring 38.

Bearing ring 13 has a portion 13' extending inwardly and on this inwardly extending portion 13' there is mounted a catch ring 40. The catch ring 40 has a stop 41 which fits between the two ends 38*a* of spring 38. The stop 41 is of sufficient length axially of the hub 21 to engage either of the ends 38*a* of the spiral spring 38. This axial elongation, as seen in FIG. 1, of the stop 41 is necessary because the spiral nature of the spring 38 positions its ends 38*a* axially spaced along the hub 21 as well as circumferentially spaced from each other.

Figure 2:
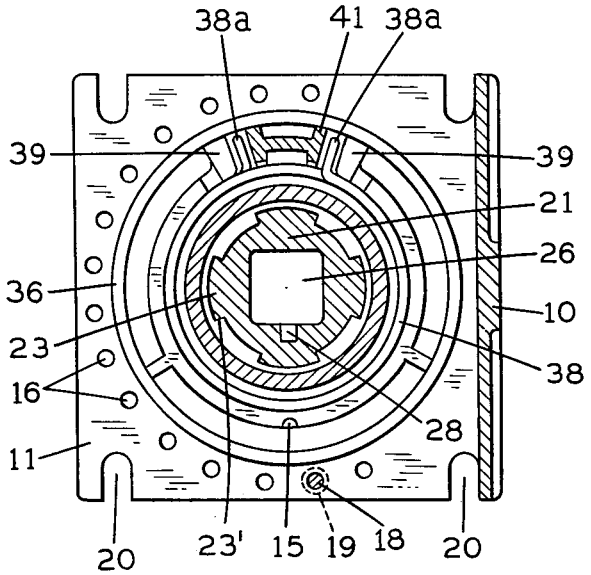
FIG. 2 is a transverse cross section through the assembled drive.

As shown in FIGS. 1, 2 and 3 two stop pins 15 are provided for insertion into selected bores 14 from outside of the bearing block (from the right end as seen in FIG. 3). These pins 15 go through and beyond the bores 14 sufficiently to be in alignment with the catch stop 41. By suitable adjustment of the stop pins 15 it is possible to limit the range of rotation of the catch stop 41 and the integral catch ring 40 relative to the bearing plate 11. Stated in another way, the pins 15 serve to limit within a predetermined angular range the rotation of the ring 40 and its stop 41.

Figure 5:
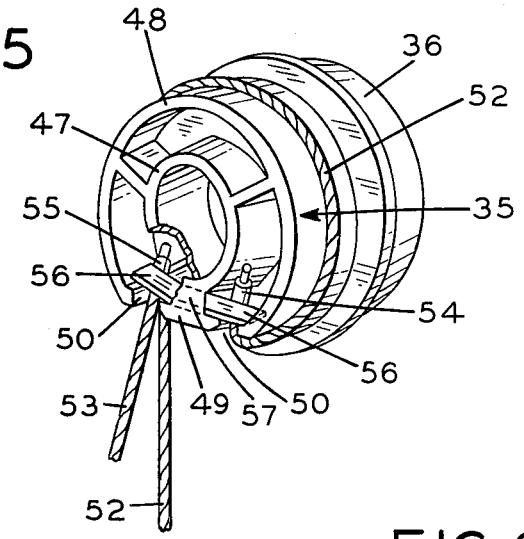
FIG. 5 is a perspective view of the tilting drum.
Figure 6:
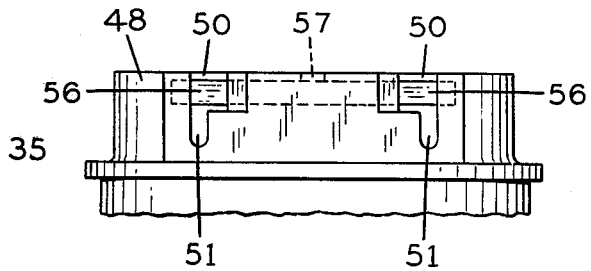
FIG. 6 is a view of a portion of the tilting drum shown in FIG. 5 as viewed from below.
Figure 7:
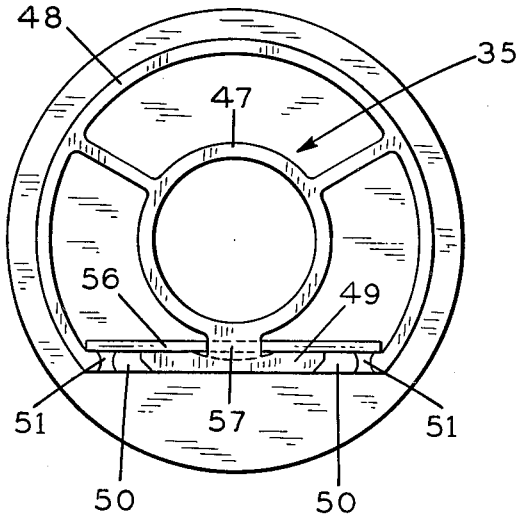
FIG. 7 is an elevational view of the end of the tilting drum which is to the left in FIG. 5.

With reference to FIGS. 5 through 7, the tilting drum 35 will be seen in greater detail as having an inner drum hub 47 and an outer drum body 48 surrounding said hub 47. Along one portion of the circumference of the drum body 48 it does not follow its circular shape but rather comprises a straight chord member 49 which extends as a chord of the circle otherwise defined by the drum body 48. Two slots 50 extend from the outer free end face of the chord 49 axially inwardly of the drum body 48. Each of the slots 50 communicates with a narrower slit 51 extending still further axially inwardly. The width of the slits 51 is such as to just snugly receive the thickness of two cords 52 and 53 which serve as tilting members for the slats to which they are connected in a conventional manner (not shown). On their ends, the two cords 52 and 53 have end pieces 54 and 55 respectively which are of such a size as to be retained by the slits 51 and not pass therethrough. The slots 50 are, however, large enough to pass the end pieces 54 and 55 without difficulty.

A leaf spring 56 is tightly received between the outer circumference of the drum hub 47 and the facing surface of the chord member 49. A radially extending member 57 extends between the drum hub 47 and the chord member 49 to prevent the leaf spring 56 from slipping outwardly toward the free end face of the tilting drum 35. This leaf spring 56 extends along the length of the surface of chord member 49 and, adjacent its ends, it overlies slots 50 thus preventing the cords 52,53 from sliding axially outwardly of the slits 51 toward the free face of the drum 35 where they might fall freely through the slots 50 were it not for the spring 56.

To insert the ends 54,55 of the cords 52,53 as shown in FIG. 5 the leaf spring 56 may be raised slightly with a screw driver or the thumb nail or by merely pushing the end pieces 54 and 55 upwardly against the spring 56 through the slot 50 until the end pieces 54,55 have passed the spring whereupon the spring, due to its resiliency, will spontaneously reassume its flat position again securing the cords 52,53 in position.

ASSEMBLY

When assembling and installing the drive mechanism for a venetian blind, all of the parts 36 to 41 of the slip clutch, the tilting drum 35 and the lift tape drum 30' are positioned in axial alignment with one another in the space between the two bearing plates 11 and 12 and then the hub 21 is introduced from the outside i.e. from the right as viewed in FIG. 3. Once the parts have been assembled to the position shown in FIG. 3, the retaining pin 29 is introduced through groove 28 on the interior of the hub 21, through the aligned opening 34, through the loop "L" (which is positioned in groove 28') and into the aligned bore in the left hand flange 30 and bearing ring 32. The outer end **29*a* of the retaining pin 29 is bent to provide a small head or handle and the same is received within a groove or notch 21*a* on the outer end of the bearing portion 22 of the hub 21. The two stop pins 15 are then inserted in selected bores 14 and the axle 18 with its lift tape guide roller 19 rotatably mounted thereon are mounted in selected aligned openings 16 and 17. The head 18*a* of axle 18 limits the insertion of the axle 18 and prevents its complete passage through the plate 11**.

Finally, retaining cap 42 is placed on the outer side of bearing plate 11 and fastened by screw 43 extending into tapped bore 44 of the bearing plate 11. As previously mentioned, the retaining cap 42 extends over the circumferential portion of the outer end of the hub 21 to secure the same against outward displacement (to the right as viewed in FIG. 3). The retaining cap 42 further secures the retaining pin 29, the axle 18 and the stop pins 15 in position and the entire drive mechanism is accordingly now assembled and held together essentially by the retaining cap 42 and the single screw 43.

A covering hood 45 is shaped to conform to the outer contours of the clutch housing 36 and the tilting drum 35. The hood 45 is, accordingly, inserted between the bearing plates 11 and 12 and secured in place by screw 46 which passes through one of the bores 16 in bearing plate 11 and then into a tapped bore 46' in the housing 45.

The square opening 26 of hub 21 receives the square drive shaft 27 which is so dimensioned as to fit freely through an opening 42' in the retaining cap 42. At its inner end, the opening 26 is defined by the fingers 25 and the bridging elements 31 thus insuring that lift drum 31' is always driven upon rotation of drive shaft 27. The drive shaft extends completely through the drive mechanism to the opposite end of the head rail (not shown) where it extends into a like bore 26 in another drive mechanism for the opposite side of the blind. The shaft, as is well known, may be of a single piece from one end of the head rail to the other or, conveniently, it can be made of two, three or more pieces joined together lengthwise within the headrail by any suitable means.

OPERATION

Once the drive shaft 27 is permanently connected to the hub 21 by means of its engagement in the opening 26, it is also non-rotationally connected to the lift tape drum 30' as above mentioned. If the drive shaft 27 is now operated (by any mechanism such as a crank, not shown), the drive mechanism will be activated. For example, if the drive shaft 27 is rotated clockwise as viewed in FIG. 2 then in that event the clutch housing 36, and the tilting drum 35 will all initially be rotated by virtue of the spring 38 which frictionally engages on the clutch ring 37 which is secured by splines 23 and grooves 23' to the hub 21. Lift tape drum 30' will also be rotated. During this initial rotation, the shaft 27 rotates clutch ring 37 and spring 38 which is frictionally engaged about the circumference thereof. Rotation of the spring 38 brings its end **38*a* which is to the right in FIG. 2 into engagement with the housing stop 39 which is to the right in FIG. 2 thus effecting rotation of clutch housing 37 with which the stops 39 are integral as well as rotating the tilting drum 35 which is also integral with the housing 36. Since the tilt cords 52,53 are secured to the tilt drum 35 the tilt cords 52,53** will be operated to tilt the slats of the blind to any desired position.

If rotation of the drive shaft 27 is continued, a point is eventually reached at which the catch stop 41 of the catch ring 40 comes up against one of the pins 15. If the drive shaft 27 is rotated clockwise as viewed in FIG. 2, it will be the right hand side of the catch stop 41 which contacts the stop pin 15. This stops rotation of the catch ring 40 and its stop 41. Shortly (almost immediately) thereafter the end 38*a* of spring 38 which is to the left of FIG. 2 will come up against the left hand side of the catch stop 41 whereupon a slight opening of the diameter of the spring 38 will be effected sufficiently to allow the clutch ring 37 to rotate relatively freely within spring 38. Accordingly, further movement or rotation of drive shaft 27 does not result in further rotation of the clutch housing 36 or its integral tilting drum 35. At the same time, however, drive shaft 27 is permitted to continue rotation by virtue of the loosening of the frictional engagement between the spring 38 and clutch ring 37. The pins 15 are so located in openings 14 that upon engagement thereof by the stop 41 the angular tilted position of the slats has reached one extreme (either fully open or fully closed).

Upon continued rotation of the drive shaft 27 no further tilting adjustment of the slats of the blind will be accomplished; however, the lifting drum 30' will continue to rotate to raise or lower the blind as the case may be.

Upon rotation of the drive shaft 27 in the opposite direction the pressure of the left hand end 38*a* of spring 38 against the stop 41 will be relieved and the spring 38 will again grip tightly about clutch ring 37 for movement in the opposite direction. Continued operation of drive shaft 27 in said opposite direction effects the raising or lowering of the blind as the case may be and the tilting of the slats in the opposite direction until the full range of tilting is reached in the opposite direction; whereupon the left hand side of stop 41 (as viewed in FIG. 2) will come up against the other pin 15 and the right hand end 38*a* of spring 38 will come up against the right hand side of stop 41 causing a slight opening of the spring 38 and stopping the drive of the tilting drum 35 with the slats tilted to their other extreme position. The drive shaft 27, however, can continue to operate the lift drum 30' to raise or lower the blind as the case may be.

If at any time the drive shaft 27 is locked or braked in a relatively fixed position and an external load is applied (say to the slats or the cords 52,53) which load tends to activate the tilting drum 35 in either of its two possible directions of rotation, one of the housing stops 39 bears against one of the ends 38*a* and tends to move it toward the other end 38*a*. This action contributes to the spring 38 being further compressed thus increasing the friction between the spring 38 and the clutch ring 37 and accordingly effectively resisting operation of the tilting drum 35 and tilting of the slats.

I claim:

1. In a drive for a venetian blind which blind has slats that may be raised or lowered by a lift tape and which slats may be tilted by a tilting member and in which said drive includes a lift tape drum, a tilting drum, a drive shaft engaged with the lift tape drum to drive the same, a slip clutch interposed between said drive shaft, and said tilting drum, and a bearing block having two substantially parallel bearing plates between which bearing plates the lift tape drum, the tilting drum, and the slip clutch are positioned and between which bearing plates said drive shaft extends, the improvement wherein an elongated hub extends between and is supported by said bearing plates, said drive shaft extends through said hub, said slip clutch is mounted on said hub in a first axial zone, said tilting drum is mounted on said hub in a second axial zone, said lift tape drum is mounted on said hub in a third axial zone, said lift tape drum comprising two generally parallel spaced disk-like flanges, bridging elements connecting said flanges and extending therebetween, said bridging elements being spaced apart circumferentially to define spaces therebetween, said hub in its zone engaged with said lift tape drum being defined by circumferentially spaced axially extending fingers dimensioned to fit within the spaces defined by said bridging elements and said fingers together with said bridging elements defining a substantially continuous core for said lift tape drum.

2. The drive according to claim 5 including said hub having a longitudinal groove, the flanges of said lift tape drum having openings in alignment with said groove, a retaining pin positioned in said groove and in said openings, a loop on one end of said lift tape positioned between the flanges of said lift tape drum, and said retaining pin extending through said loop.

3. In a drive for a venetian blind which blind has slats that may be raised of lowered by a lift tape and which slats may be tilted by a tilting member and in which said drive includes a lift tape drum, a tilting drum, a drive shaft engaged with the lift tape drum to drive the same, a slip clutch interposed between said drive shaft, and said tilting drum, and a bearing block having two substantially parallel bearing plates between which bearing plates the lift tape drum, the tilting drum, and the slip clutch are positioned and between which bearing plates said drive shaft extends, the improvement wherein an elongated hub extends between and is supported by said bearing plates, said drive shaft extends through said hub, said slip clutch is mounted on said hub in a first axial zone, said tilting drum is mounted on said hub in a second axial zone, said lift tape drum is mounted on said hub in a third axial zone, said slip clutch including a clutch ring, said clutch ring being secured to said hub in a manner to prevent rotation with respect thereto, a spiral spring frictionally engaged with the outer surface of said clutch ring, said spring having two ends thereof bent to extend radially outwardly of the axis of said hub, said slip clutch also including a clutch housing extending about said spiral spring, and two inwardly extending stops in said housing positioned to cooperate with said outwardly extending ends of said spiral spring.

4. The drive according to claim 3 in which said one bearing plate has a second bearing ring extending inwardly, a catch ring rotatably mounted on said second bearing ring, a catch stop on said catch ring, at least one stop pin mounted in said one bearing plate, said catch stop being positioned between said two spring ends, and said stop pin being circumferentially aligned with said catch stop for limiting the rotational movement thereof.

5. The drive according to claim 4 in which said one bearing plate includes a plurality of bores therethrough and in which said at least one stop pin is removably positioned in a selected one of said bores.

6. The drive according to claim 5 in which said clutch housing and said tilting drum are integral.

7. The drive according to any one of the preceding claims including said first bearing plate having a first series of holes therethrough, said other bearing plate having a second series of holes therethrough in alignment with said first series, an axle extending between one of the holes of said first series and an aligned hole of said second series, a lift tape guide roller rotatably mounted on said axle, said axle being removably inserted in a pair of said aligned holes for removal and insertion in another pair of aligned holes for adjusting the position of said lift tape roller.

8. In a drive for a venetian blind which blind has slats that may be raised or lowered by a lift tape and which slats may be tilted by a tilting member and in which said drive includes a lift tape drum, a tilting drum, a drive shaft engaged with the lift tape drum to drive the same, a slip clutch interposed between said drive shaft, and said tilting drum, and a bearing block having two substantially parallel bearing plates between which bearing plates the lift tape drum, the tilting drum, and the slip clutch are positioned and between which bearing plates said drive shaft extends, the improvement wherein an elongated hub extends between and is supported by said bearing plates, said drive shaft extends through said hub, said slip clutch is mounted on said hub in a first axial zone, said tilting drum is mounted on said hub in a second axial zone, said first bearing plate having a first series of holes therethrough, said other bearing plate having a second series of holes therethrough in alignment with said first series, an axle extending between one of the holes of said first series and an aligned hole of said second series, a lift tape guide roller rotatably mounted on said axle, said axle being removably inserted in a pair of said aligned holes for removal and insertion in another pair of aligned holes for adjusting the position of said lift tape roller.

9. A tilting drum for the drive of a venetian blind which drum is connected to a tilting member for tilting the slats of said blind comprising an inner drum hub, an outer drum body surrounding said drum hub, said inner drum hub being substantially cylindrical, said outer drum body comprising less than a complete cylinder and having a chord element extending in a substantially straight line between the ends of the substantially cylindrical portion of said drum body, said chord element having at least one slot therein extending axially inwardly of said drum body, said slot communicating with a narrower slit extending still further axially inwardly of said drum body, said slit being of a width to snugly receive the thickness of said tilting member, said tilting member having an end piece of a size greater than the size of said slit, said end piece being small enough to pass through said slot.

10. The tilting drum of claim 9 including a leaf spring extending in covering relationship to said slot, said leaf spring being flexible to permit passage through said slot of said end piece.

11. The tilting drum of claim 10 in which said leaf spring is positioned between the outer surface of said drum hub and said chord element.

12. The tilting drum of claim 11 including a retainer element extending between said drum hub and said chord element to assist in retaining said leaf spring in position.

* * * * *

UNITED STATES PATENT AND TRADEMARK OFFICE

CERTIFICATE OF CORRECTION

PATENT NO. : 4,200,135

DATED : April 29, 1980

INVENTOR(S) : Petrus J. Hennequin

It is certified that error appears in the above-identified patent and that said Letters Patent are hereby corrected as shown below:

Column 7, line 68, insert --and-- after "zone,".
Column 8, line 34, insert --and-- after "zone,".

Signed and Sealed this

*Nineteenth* Day of *August 1980*

[SEAL]

*Attest:*

SIDNEY A. DIAMOND

*Attesting Officer*

*Commissioner of Patents and Trademarks*